US008256926B2

(12) United States Patent
Louh

(10) Patent No.: US 8,256,926 B2
(45) Date of Patent: Sep. 4, 2012

(54) ILLUMINATION DEVICE

(75) Inventor: Sei-Ping Louh, Tu-Cheng (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 198 days.

(21) Appl. No.: 12/485,932

(22) Filed: Jun. 17, 2009

(65) Prior Publication Data

US 2009/0323331 A1 Dec. 31, 2009

(30) Foreign Application Priority Data

Jun. 30, 2008 (CN) ..... 2008 1 0302451

(51) Int. Cl.
*F21V 29/00* (2006.01)

(52) U.S. Cl. ... 362/294; 362/373; 362/800; 362/249.02; 362/311.02

(58) Field of Classification Search ..... 362/249.02, 362/294, 373, 311.02, 800
See application file for complete search history.

(56) References Cited

U.S. PATENT DOCUMENTS

| | | | | |
|---|---|---|---|---|
| 7,144,140 | B2 * | 12/2006 | Sun et al. | 362/373 |
| 7,524,089 | B2 * | 4/2009 | Park | 362/294 |
| 7,549,772 | B2 * | 6/2009 | Wang | 362/294 |
| 7,628,513 | B2 * | 12/2009 | Chiu | 362/311.02 |
| 7,677,767 | B2 * | 3/2010 | Chyn | 362/294 |
| 7,712,927 | B2 * | 5/2010 | Shuai et al. | 362/294 |
| 2004/0170017 | A1 * | 9/2004 | Zhan et al. | 362/240 |
| 2005/0111234 | A1 * | 5/2005 | Martin et al. | 362/555 |
| 2007/0236935 | A1 * | 10/2007 | Wang | 362/294 |
| 2007/0242461 | A1 * | 10/2007 | Reisenauer et al. | 362/294 |
| 2008/0037255 | A1 * | 2/2008 | Wang | 362/294 |
| 2008/0266866 | A1 * | 10/2008 | Tsai | 362/294 |
| 2009/0046473 | A1 * | 2/2009 | Tsai et al. | 362/373 |
| 2009/0067182 | A1 * | 3/2009 | Hsu et al. | 362/373 |
| 2010/0165630 | A1 * | 7/2010 | Lin et al. | 362/294 |
| 2010/0232168 | A1 * | 9/2010 | Horng et al. | 362/373 |

FOREIGN PATENT DOCUMENTS

| | | |
|---|---|---|
| CN | 2713301 Y | 7/2005 |
| CN | 2938416 Y | 8/2007 |

* cited by examiner

*Primary Examiner* — Jason Moon Han
*Assistant Examiner* — Jessica M Apenteng
(74) *Attorney, Agent, or Firm* — Altis Law Group, Inc.

(57) ABSTRACT

An illumination device includes a lampshade, a heat dissipation module, a light module and a lamp cap. The lampshade includes a shell and an optical lens fixed on the shell. The heat dissipation module includes a plurality of heat sinks, a bottom plate coupled to the heat sinks, and a cavity defined in the center of the heat dissipation module. The light module is received in the cavity and toward the optical lens, including a substrate and a light source mounted on the substrate. The lamp cap is coupled to the heat dissipation module and away from the optical lens.

7 Claims, 3 Drawing Sheets

ILLUMINATION DEVICE

BACKGROUND

1. Technical Field

The present disclosure relates to illumination devices, and particularly, to a light-emitting diode (LED) illumination device.

2. Description of Related Art

LED lamps generally have a higher light intensity than fluorescent lamps, where a plurality of LEDs are often arranged into crowded groups. Thus, heat generated by the plurality of LEDs concentrate, and create uneven heat distribution over an LCD board. Thus, the LCD board is not able to dissipate the locally-concentrated and unevenly-distributed heat quickly and efficiently. Such accumulation may cause the LEDs to overheat and to experience unstable operation or even malfunction.

Therefore, an illumination device is desired to overcome the limitations described.

BRIEF DESCRIPTION OF THE DRAWINGS

Many aspects of an illumination device can be better understood with reference to the following drawings. The components in the drawings are not necessarily drawn to scale, the emphasis instead being placed upon clearly illustrating the principles of the present apparatus for assembling a machine tool. Moreover, in the drawings, like reference numerals designate corresponding parts throughout the several views.

DETAILED DESCRIPTION

Figure 1:
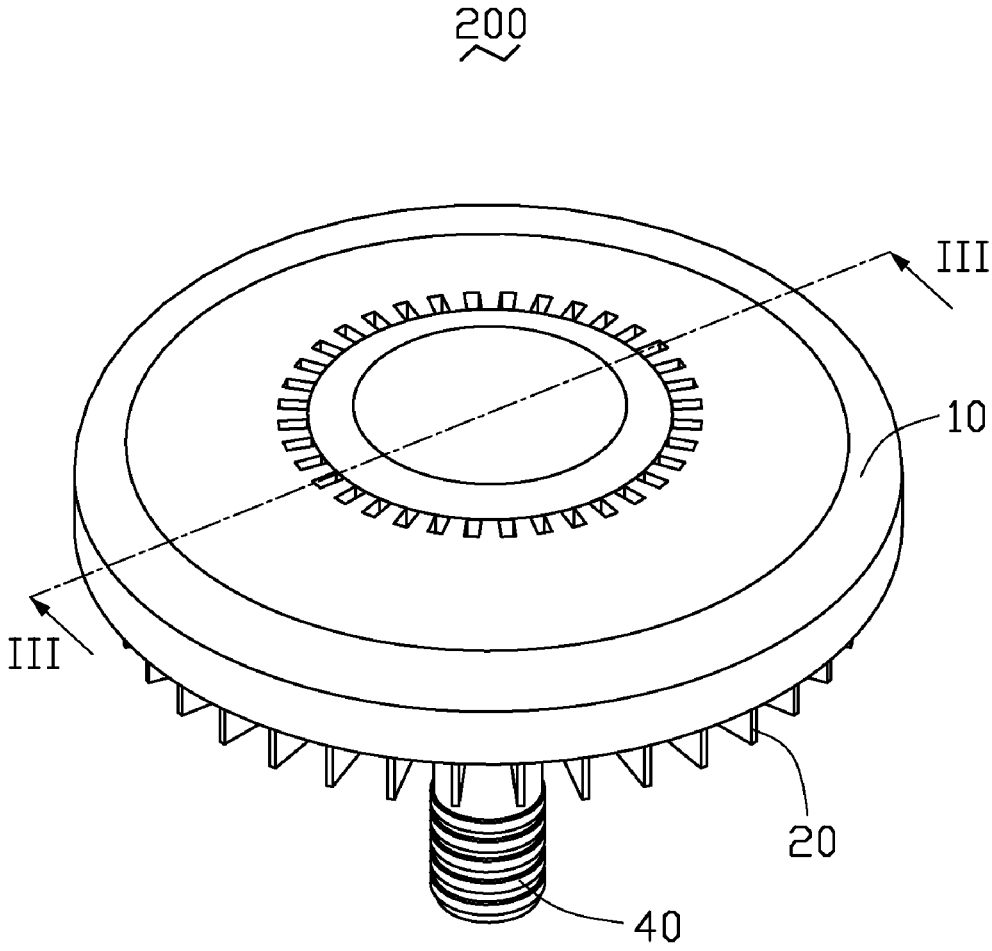
FIG. 1 is an assembled, isometric view of an exemplary illumination device.
Figure 2:
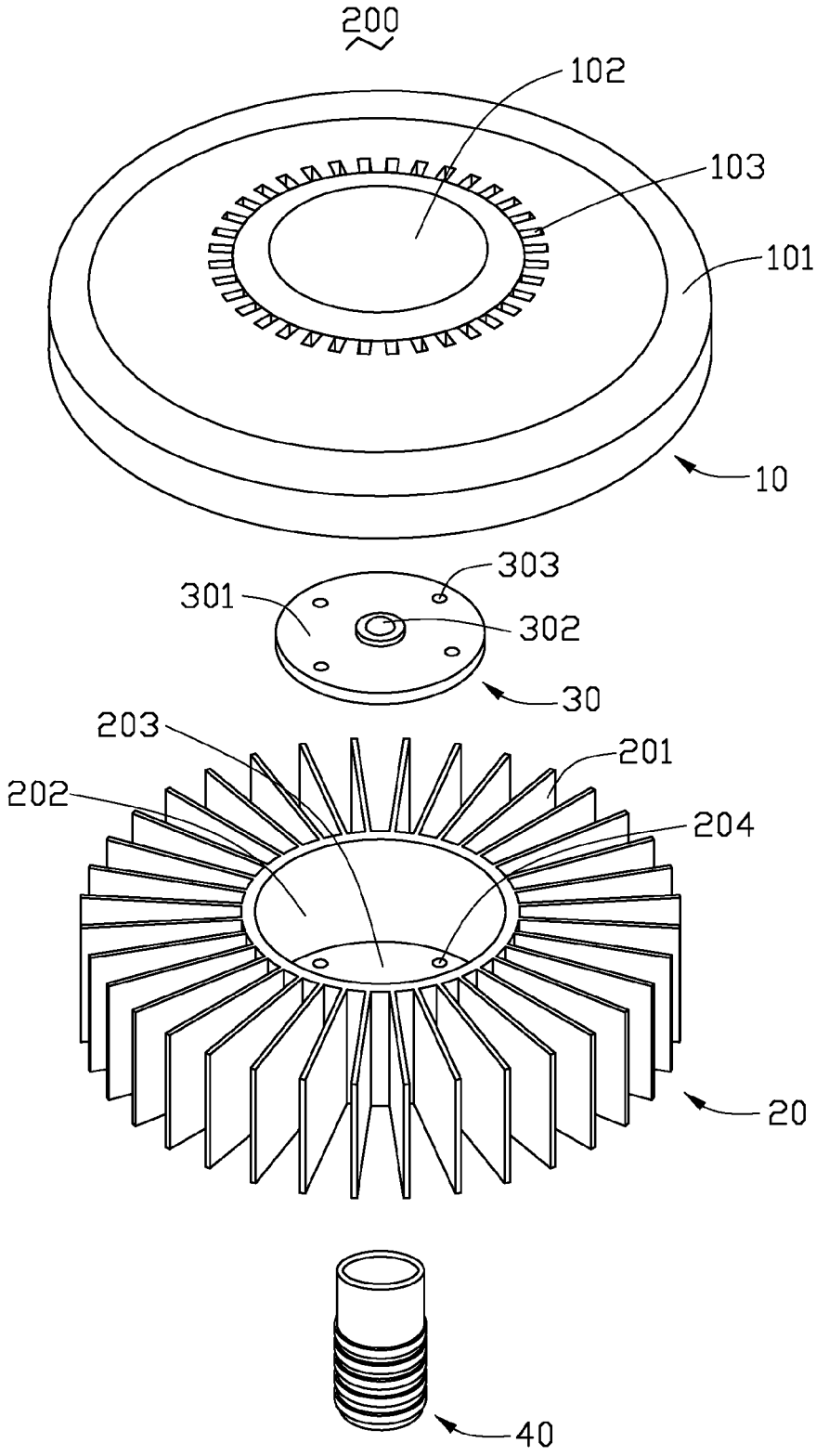
FIG. 2 is an exploded view of FIG. 1.
Figure 3:
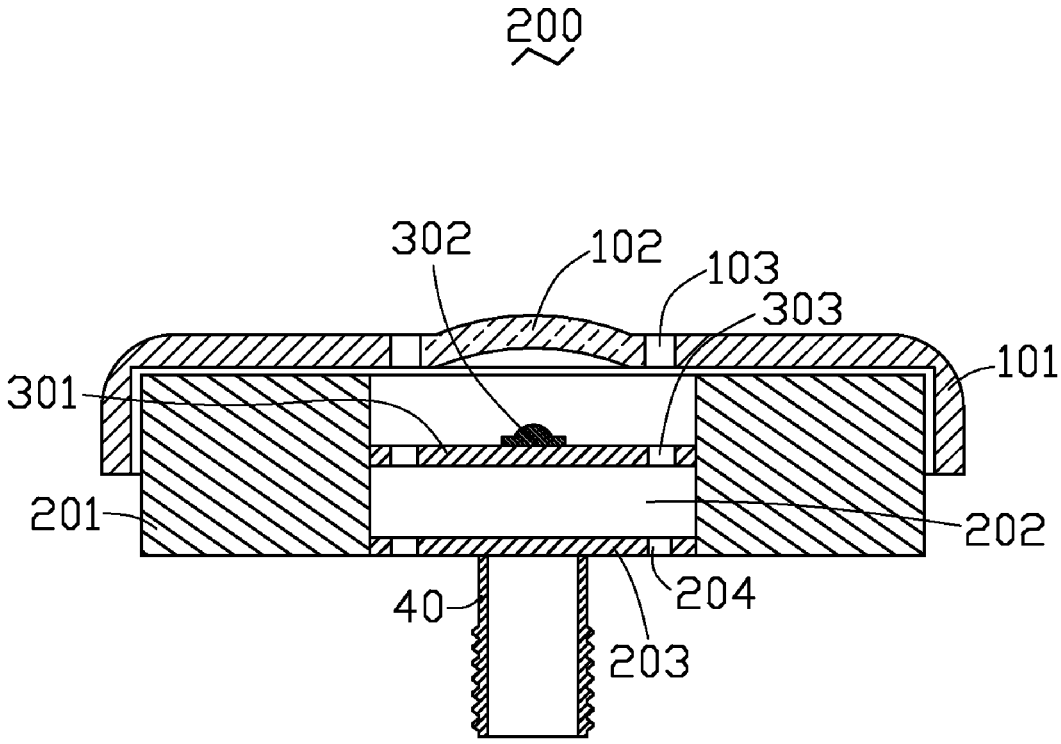
FIG. 3 is a cross section of the illumination device of FIG. 1, taken along line III-III thereof.

Referring to FIGS. 1-3, an illumination device 200 in accordance with one embodiment of the present disclosure is used in environments requiring high lighting intensity, such as indoor lighting, gymnasiums, courtyards, streets, and others.

The illumination device 200 includes a lampshade 10, a heat dissipation module 20, a light module 30, and a lamp cap 40. The lampshade 10 includes a shell 101 and an optical lens 102 fixed on the shell 101. The shell 101 includes a plurality of first through holes 103. The first through holes 103 are defined in the shell 101 surrounding and positioned close to the optical lens 102.

The heat dissipation module 20 is integrally made of metal with a good heat conductivity, such as aluminum, copper, and alloys thereof. A part of the heat dissipation module 20 is received in the lampshade 10. The heat dissipation module 20 includes a plurality of heat sinks 201, a bottom plate 203 connected to the heat sinks 201, and a cavity 202 defined in the center of the heat dissipation module 20. The heat sinks 201 extend outwardly and radially from an outer circumferential surface of the cavity 202. The bottom plate 203 is fixed on one side of the cavity 202 and away from the optical lens 102. The bottom plate 203 defines a plurality of second through holes 204 corresponding to the first through holes 103 of the shell 101.

The light module 30 is received in the cavity 202 and toward the optical lens 102. The light module 30 includes a substrate 301 and a light source 302 mounted on the substrate 301. While in the illustrated embodiment, light source 302 is shown as a LED chip, it will be appreciated that a plurality of LED chips, a plurality of LEDs, or a plurality of LED modules will be equally applicable and remain well within the scope of the disclosure. The substrate 301 defines a plurality of third through holes 303 corresponding to the first through holes 103 and the second through holes 204. The third through holes 303 are surrounding and positioned near the light source 302.

The lamp cap 40 connects to the heat dissipation module 20. Here, lamp cap 40 is fixed on the bottom plate 203 of the heat dissipation module 20 and away from the optical lens 102. The lamp cap 40 is integrally metal with good heat conductivity, such as aluminum, copper and alloys thereof. Light emitted from the light source 302 passes through the optical lens 102. Thus, the light module 30 can generate light over a large-scale illumination area.

In use, when the light module 30 is activated to illuminate. Heat generated by the light source 302 is conducted to the heat dissipation module 20 via the substrate 301. The heat accumulated in the substrate 301 is quickly and substantially transferred to the heat sinks 201 for dissipation into the ambient air, and the second through holes 204 of the heat dissipation module 20 corresponding to the first through holes 103 and the third through holes 303 dissipate the heat by natural convection, thus avoiding local concentrations and uneven distribution of the heat occurring on the heat dissipation module 20. Therefore, the heat generated by the light source 302 can be dissipated to the ambient air via the heat sink 201, the first through holes 103, the second through holes 204, and the third through holes 303 sufficiently and rapidly; accordingly, the light source 302 can be maintained within its predetermined temperature range when operating.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An illumination device, comprising:

a lampshade comprising a shell and an optical lens fixed on the shell, wherein the shell defines a plurality of first through holes surrounding the optical lens;

a heat dissipation module comprising a hollow tube with a cavity extending therethrough, a plurality of heat sinks extending outwardly and radially from an outer surface of the tube, a bottom plate coupled to and sealing a bottom of the hollow tube, the lampshade being coupled to and sealing a top of the hollow tube, the first through holes of the lampshade being located over and communicating with the cavity of the hollow tube, wherein a part of the heat dissipation module is received in the lampshade, wherein the bottom plate defines a plurality of second through holes corresponding to and aligned with the first through holes;

a light module received in the cavity of the hollow tube of the heat dissipation module and arranged between and spaced from the bottom plate and toward the optical lens, comprising a substrate and a light source mounted on the substrate and facing toward the optical lens, the substrate defining a plurality of third through holes in alignment with and communicating with the first through holes and the second through holes; and a lamp cap coupled to the heat dissipation module and away from the optical lens.

2. The illumination device of claim 1, wherein the heat dissipation module comprises aluminum, copper, or aluminum and copper alloys.

3. The illumination device of claim 1, wherein the third through holes surround the light source.

4. The illumination device of claim 1, wherein the light source is a light-emitting diode (LED) chip, LED, or LED module.

5. The illumination device of claim 1, wherein the light source comprises a plurality of LED chips, a plurality of LEDs, or a plurality of LED modules.

6. An illumination device, comprising:

a lampshade comprising a shell and an optical lens fixed on the shell, wherein the shell defines a plurality of first through holes surrounding the optical lens;

a heat dissipation module comprising a hollow tube at a center thereof and a plurality of heat sinks with top ends thereof coupled to the shell, the heat sinks extending outwardly and radially from an outer surface of the tube, the first through holes being located over and communicating with an interior of the hollow tube, a bottom plate coupled to a bottom of the hollow tube, the bottom plate defining a plurality of second through holes in alignment with the first through holes; and a light module received in the hollow tube and comprising a substrate fixed to the hollow tube and spaced from the bottom plate and lampshade and a light source mounted on the substrate and towards the optical lens, the substrate defining a plurality of third through holes in alignment with and communicating with the first through holes and the second through holes.

7. The illumination device of claim 6, wherein the third through holes surround the light source.

* * * * *